US006240888B1

(12) United States Patent
Pilney

(10) Patent No.: US 6,240,888 B1
(45) Date of Patent: Jun. 5, 2001

(54) INTERNAL COMBUSTION ENGINE DECOMPRESSION VALVE KIT AND METHOD FOR MAKING SAME

(76) Inventor: Rich Pilney, 131 Smithfield St., Dillonvale, OH (US) 43917

( * ) Notice: Subject to any disclaimer, the term of this patent is extended or adjusted under 35 U.S.C. 154(b) by 0 days.

(21) Appl. No.: 09/498,853

(22) Filed: Feb. 7, 2000

(51) Int. Cl.[7] ..... F02N 17/08

(52) U.S. Cl. ..... 123/169 V; 123/182.1; 313/120

(58) Field of Search ..... 123/182.1, 169 V; 313/120

(56) References Cited

U.S. PATENT DOCUMENTS 1,492,007 * 4/1924 Wayte ..... 123/169 V
2,490,646 * 12/1949 Murphy et al. ..... 123/169 V
4,326,145 * 4/1982 Foster et al. ..... 313/120

* cited by examiner

*Primary Examiner*—Andrew M. Dolinar
(74) *Attorney, Agent, or Firm*—John D. Gugliotta; Michael J. Corrigan

(57) ABSTRACT

The invention is a decompression kit for large bore and/or high compression internal combustion engines. Specifically designed for engines such as the "Harley-Davidson®" "V-Twin®" or the "Sportster®" models, the invention vents high cylinder pressure and reduces the associated high starter torque required to turn the crankshaft when starting the engine, this in turn reduces the cranking amperage necessary to start the engine resulting in longer starter and battery life. A modified spark plug, steel tubing, and decompression valves are the main components of the invention. Cylinder pressure during the compression stroke is vented through the spark plug, tubing, and the decompression valve to make starting the engine easy.

9 Claims, 5 Drawing Sheets

INTERNAL COMBUSTION ENGINE DECOMPRESSION VALVE KIT AND METHOD FOR MAKING SAME

RELATED APPLICATIONS

There are no previously filed, nor currently any co-pending applications, anywhere in the world.

BACKGROUND OF THE INVENTION

1. Field of the Invention

The present invention relates generally to decompression devices for internal combustion engines and, more particularly, to an aftermarket cylinder decompression device for motorcycle engines for activation during engine start up and the method for making same.

2. Descridption of the Related Art

Internal combustion engines and other high compression engines require a large cranking torque in order to start the engine. This can be especially difficult during cold starts. The large amount of cranking torque required places a great strain on starter motor and battery life often resulting in premature failure.

Various mechanism have been developed in order to provide compression relief during starting such as relief valves, decompression ports, and decompression slots formed in the walls of the cylinder. These devices vent a portion of the internal cylinder pressure during the compression stroke during startup in internal combustion engines thereby reducing the amount of torque needed to turn the crankshaft during start up.

In the related art, there exists patents for devices of this type for two-cycle engines. Typically, these devices are integrally built into the engine and there exists many attempts to engage the device upon startup by tying it to the starter recoil mechanism or via operator actuated means. However, no patents exist in the art for an aftermarket engine cylinder decompression device that can be used with many types of engines, particularly four-stroke motorcycle engines. Also, it is not always desirable to have the decompression device activated and devices of this type cannot be deactivated.

A search of the prior art did not disclose any patents that read directly on the claims of the instant invention; however, the following references were considered related:

| U.S. Pat. No. | Inventor | Issue Date |
|---|---|---|
| 5,799,635 | Aljabari | Sep 1, 1998 |
| 3,687,124 | Kolorz | Aug. 29, 1972 |
| 5,701,860 | Horiuchi et al. | Dec. 30, 1997 |
| 5,582,143 | Stark et al. | Dec. 10, 1996 |
| 5,379,734 | Tsunoda et al. | Jan. 10, 1995 |
| 5,361,738 | Iida | Nov. 8, 1994 |
| 5,116,287 | Hironaka et al. | May 26, 1992 |
| 5,687,683 | Knoblauch | Nov. 18, 1997 |
| 4,394,851 | Greier et al. | Jul. 26, 1983 |
| 4,184,468 | Freyn | Jan. 22, 1980 |
| 5,630,385 | Taomo | May 20, 1997 |
| 5,377,642 | Morrow et al. | Jan. 3, 1995 |
| 4,993,372 | Mott et al. | Feb. 19, 1991 |

Consequently, a need has been felt for providing an aftermarket motorcycle engine decompression device for use during engine startup.

SUMMARY OF THE INVENTION

It is therefore an object of the present invention to provide an improved motorcycle engine decompression valve to reduce the amount of torque required at engine startup.

It is another object of the present invention to provide an aftermarket motorcycle engine decompression valve that can used with virtually any motorcycle engine.

It is yet another object of the present invention to reduce the possibility of engine lock up during start up.

It is yet still another object of the present invention to preserve battery and starter motor life on electric start motorcycles.

It is still yet another object of the present invention to be operator activated only as required.

It is a benefit of the present invention that no disassembly of the motorcycle engine or machine shop work is required to install.

It is an advantage of the present invention it is easily installed at a relatively small cost.

Briefly described according to one embodiment of the present invention, provided is a decompression kit for large bore and/or high compression internal combustion engines. Specifically designed for engines such as the "Harley-Davidson®" "V-Twin®" or the "Sporster®", the device vents high cylinder pressure and the associated high torque required to turn the crankshaft when starting the engine. The device also minimizes the possibility of dangerous kick back of the kick starter during manual starts. A modified spark plug, steel tubing, and decompression valves are the main components of the invention. Cylinder pressure during the compression stroke is vented through the spark plug, tubing, and the decompression valve to make starting the engine easy.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| LIST OF REFERENCE NUMBERS | |
|---|---|
| 5 | motorcycle engine |
| 6 | cylinder |
| 7 | piston |
| 8 | piston rod |
| 9 | crankshaft |
| 10 | cylinder walls |
| 11 | cylinder head |
| 12 | combustion chamber |
| 13 | intake valve |
| 14 | exhaust valve |
| 15 | spark plug port |
| 20 | decompression valve assembly |
| 21 | relief valve |
| 21a | plunger |
| 21b | valve base |
| 22 | tubing |
| 23 | gas port chamber |
| 23a | vent aperture |
| 23b | plug aperture |
| 23c | lip |
| 23d | chamber area |
| 24 | spark plug |
| 24a | threaded base |
| 24b | aperture |
| 24c | slot |
| 24d | dielectric |
| 24e | electrode |

DESCRIPTION OF THE PREFERRED EMBODIMENTS

The best mode for carrying out the invention is presented in terms of its preferred embodiment, herein depicted within the FIGS.

1. Detailed Description of the Figures

Figure 1:
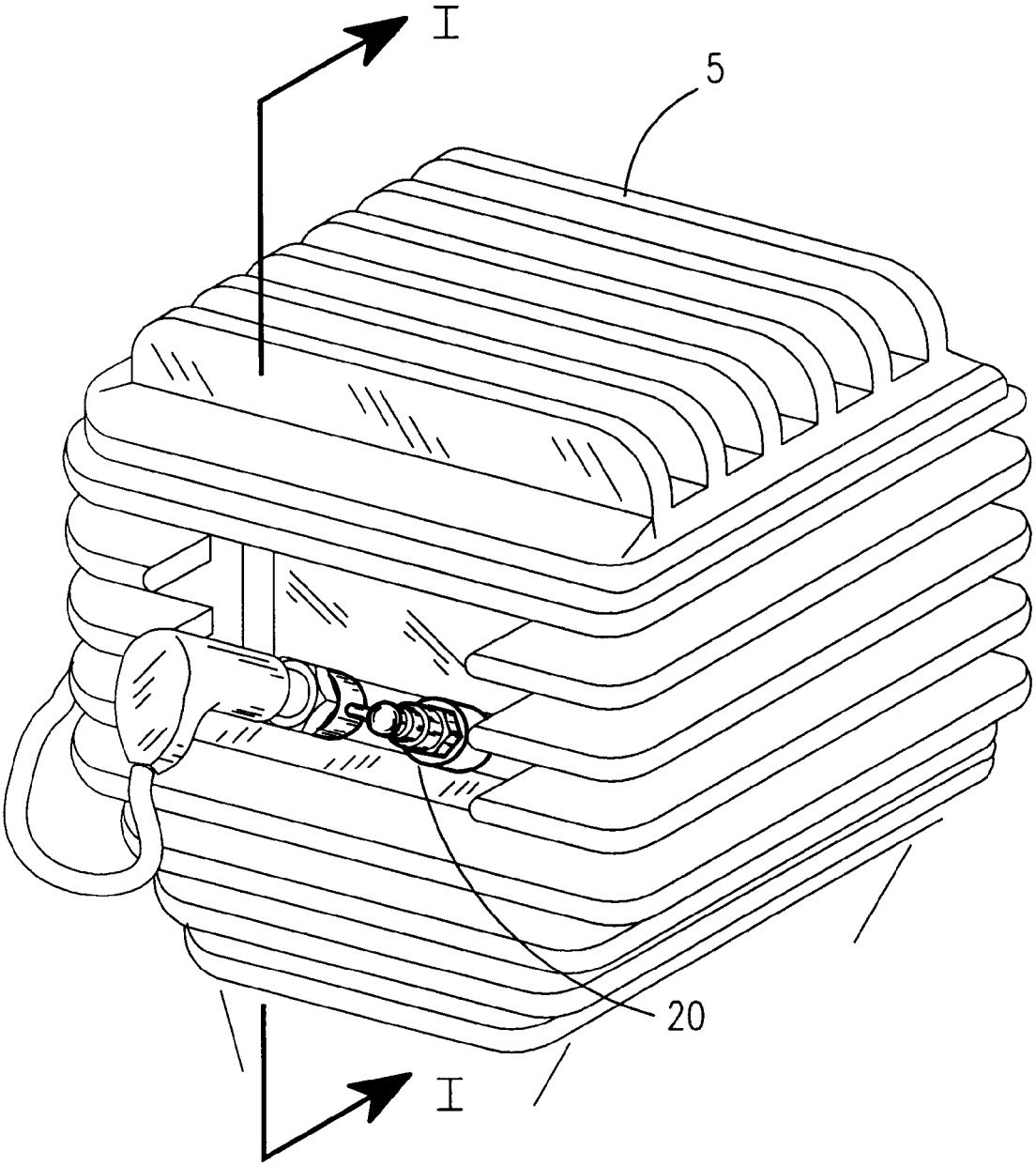
FIG. 1 is a partially cutaway view of motorcycle engine having a decompression valve installed, according to the preferred embodiment of the present invention.
Figure 2:
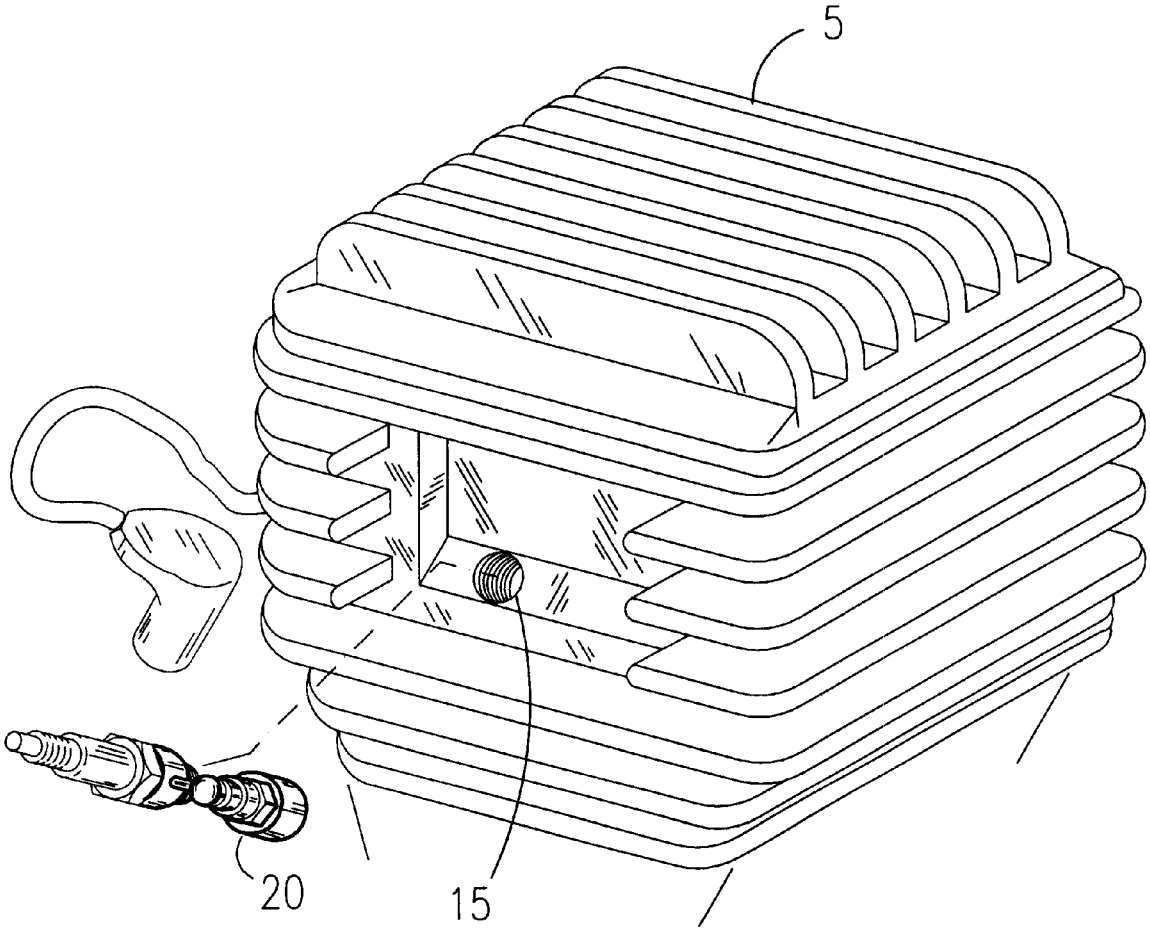
FIG. 2 is a partially cutaway exploded view of motorcycle engine and the decompression valve removed from the spark plug socket, according to the preferred embodiment of the present invention.
Figure 3:
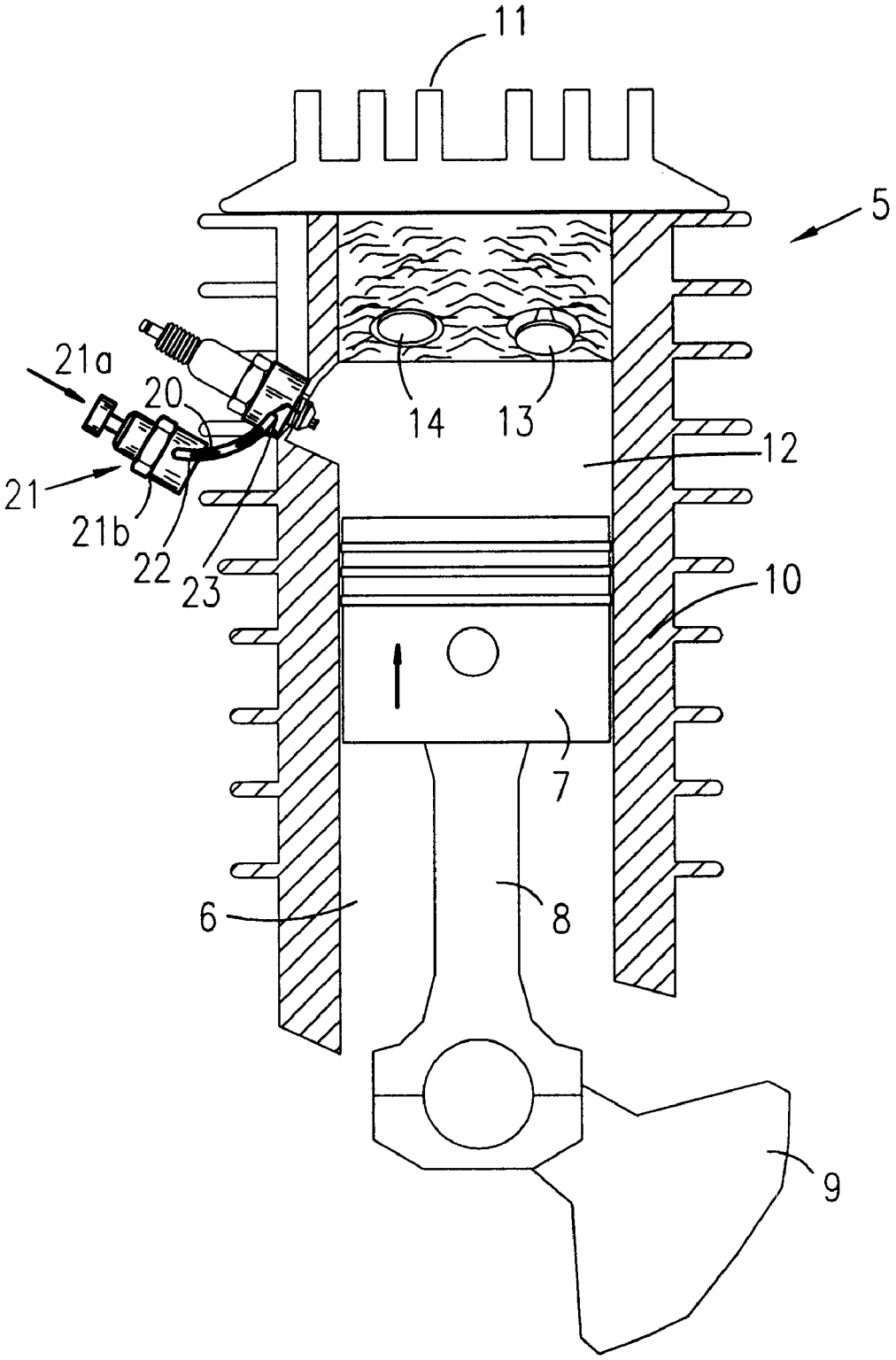
FIG. 3 is a partial cutaway cross sectional view taken along I—I of FIG. 1 with the decompression valve installed, according to the preferred embodiment of the present invention.

Referring now to FIGS. 1 and 2, a decompression valve 20 for large bore and/or high compression internal combustion motorcycle engines is shown, according to the present invention, particularly for the "Harley-Davidson®" "V-Twin®"(shown in FIG. 1) or the "Sporster®"(not shown) models although it is envisioned the device 20 could be adapted to for use with virtually any internal combustion engine found in motorcycles, snowmobiles, go-karts, chain saws, lawn mowers, etc. The device 20 is essentially a modified spark plug to be installed in the spark plug port 15 in place of the regular spark plug. A small slot (described further hereinbelow) is cut into the sidewall of the threaded base portion of the spark plug to allow cylinder pressure to escape to the exterior of the sidewall and where it is received in a gas chamber of a gas port that physically encapsulates the threaded portion of the spark plug between the base of the spark plug and the cylinder head. A small diameter tube connects the gas chamber to a valve that is physically located close to the spark plug and cylinder head. The valve allows a small amount of cylinder pressure to be released to the atmosphere when a plunger on the top is depressed. When the operator desires to start the engine the plunger on the top of the valve is depressed then the starter button is depressed until the engine starts.

Figure 4:
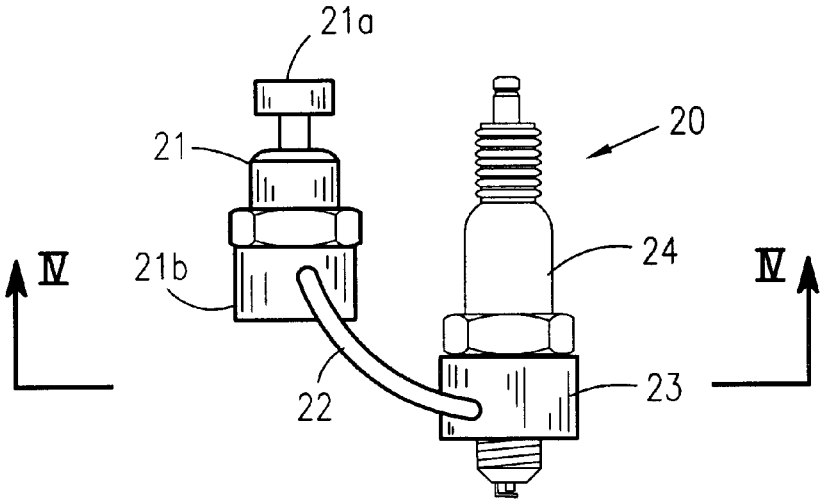
FIG. 4 is a front view of a decompression valve for a motorcycle engine such as the "Harley-Davidson®" "V-Twin®", according to the preferred embodiment of the present invention.
Figure 5:
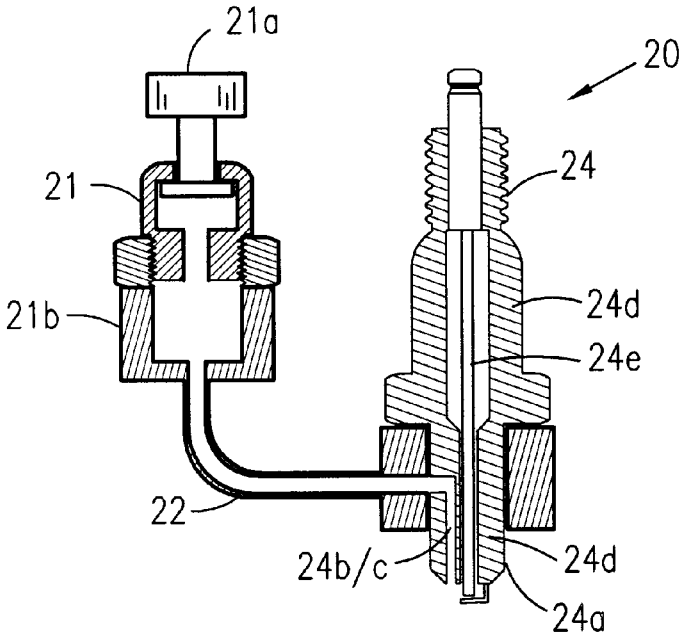
FIG. 5 is a front cross sectional view taken along line IV—IV of FIG. 4 of a decompression valve for a motorcycle engine such as the "Harley-Davidson®" "V-Twin®", according to the preferred embodiment of the present invention.

Referring now to FIGS. 3 through 7, shown is the detail of the installation and operation of the device 20 for a motorcycle engine 5 as previously described. The specially modified spark plug 24 is installed in the conventional spark plug port 15 (shown in FIG. 2). The spark plug is a "hot" style which has an extended, threaded base 24*a* that normally protrudes further into the cylinder 6 when installed for higher combustion temperatures. The extended thread base 24*a* allows the installation and function of the gas port chamber 23 when the device 20 is installed. When installed in this fashion, the spark plug 24 functions as a normal spark plug. Referring specifically now to FIGS. 4 and 5, protruding from the side of gas port chamber 23 is vent tube 22 which consists of a short piece of formed or contoured steel tubing approximately two inches long, with a 0.180 inch outer diameter and 0.089 inch inner diameter. Gas port chamber 23 is connected to one end of vent tube 22, and the opposite end is connected to valve base 21*b* of valve 21. Valve 21 is a well known off the shelf component that can be obtained at a reasonable cost. All connections are welded or brazed. A valve plunger 21*a* normally biased in the closed position is located on the top of valve 21 for placing the interior chamber of valve 21 in fluid communication with the atmosphere. At final assembly, the modified spark plug 24 is placed through the gas port chamber 23 through the aperture 23*b* in the center and tightened in the spark plug port 15. While cranking the engine, the motorcycle operator simply pushes valve plunger 21*a*. Normally, as piston 6 travels upward (as depicted by the arrow in FIG. 3) air and fuel vapor are compressed to a high pressure in the combustion chamber 12 in preparation for ignition by spark plug 24. These pressures can be extremely high causing excessive amounts of torque to continue forcing piston 7 upward as crankshaft 9 is turned at startup. To ease this difficulty and aid in starting, while cranking the engine over the motorcycle operator can release a small amount of this pressure from combustion chamber 12 by depressing valve plunger 21*a*. The means whereby cylinder 6 pressure is vented to the atmosphere through gas chamber 23, vent tube 22, and valve 21 is described further hereinbelow.

Referring now specifically to FIGS. 6*a* through 6*d*, the detail of the cooperation of gas port chamber 23 with vent tube 22 and valve 21 is shown. Vent tube 22 is connected at one end to the side of gas chamber 23 and in fluid communication with the interior chamber therein depicted in FIG. 6*b* as numeral 23*d*. Vent tube 22 then is bent 90° upward and connected at the other end to the valve base 21*b* (not shown in this FIG.) being in fluid communication with the interior chamber defined therein. Preventing fluid communication of this interior chamber with the atmosphere is valve 21. However, upon depressing valve plunger 21*a* downward, valve 21 is opened and vent tube 22 and hence the interior chamber 23*d* of gas port chamber 23 are placed in fluid communication with the atmosphere.

Figure 6A:
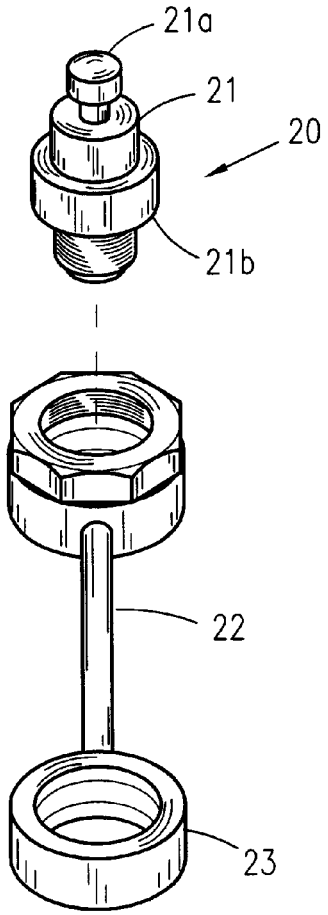
FIG. 6*a* is an exploded front view of the relief valve, valve base, tubing and gas port chamber from a decompression valve for a motorcycle engine such as the "Harley-Davidson®" "V-Twin®", according to the preferred embodiment of the present invention.
Figure 6B:
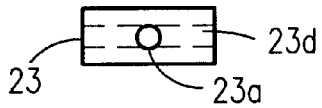
FIG. 6*b* is a side view of the gas port chamber from a decompression valve for a motorcycle engine such as the "Harley-Davidson®" "V-Twin®", according to the preferred embodiment of the present invention.
Figure 6C:
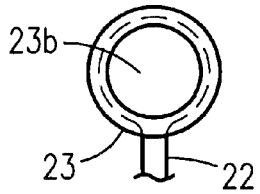
FIG. 6*c* is a top view of the gas port chamber from a decompression valve for a motorcycle engine such as the "Harley-Davidson®" "V-Twin®" showing the detail of the aperture formed in the center, according to the preferred embodiment of the present invention.
Figure 6D:
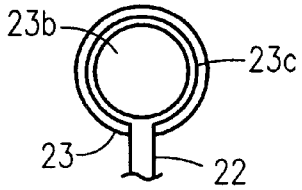
FIG. 6*d* is a bottom view of the gas port chamber from a decompression valve for a motorcycle engine such as the "Harley-Davidson®" "V-Twin®" showing the detail of second hole partially drilled in the bottom forming a lip and gas collection chamber, according to the preferred embodiment of the present invention.

Gas port chamber 23 is essentially ring shaped with an aperture 23*b* drilled in the center. Gas port chamber can be manufactured from the same material as vent tubing 22. The outer diameter of gas port chamber 23 and the diameter of aperture 23*b* necessarily will be different for different engine 5 models and manufacturers as well as different spark plugs used therewith. By way of example, for the "Harey-Davidson®" "V-Twin®" engine, the outer diameter of the gas port chamber 23 is 0.8 inch, aperture 23*b* is 0.550 inch. A second hole through the center of gas port chamber 23 is drilled with a diameter of 0.585 inch to a depth of 0.200 inch forming a lip 23*c* as can be seen in FIG. 6*d*. The area created by drilling the 0.585 inch diameter in the lower portion of gas port chamber 23 is the actual chamber 23*d* wherein cylinder gas collects before being vented through vent tube 22. When device 20 is installed, spark plug 24 is inserted through gas port chamber 23 and lip 23*c* faces downward facing the surface of cylinder wall 10 wherein spark plug port 15 is located. Chamber 23*d* then surrounds the upper portion of the threaded base 24*a* of spark plug 24. For a "Sportster®" model engine, the dimensions of the gas port chamber 23 are 0.750 inch for the outer diameter, 0.469 inch diameter for aperture 23*b*, 0.500 inch diameter for the second hole drilled to a depth of 0.200 inch to form chamber 23*d* and lip 23*c*. Of course, these particular dimensions are for the models listed and in no way imply any limitation on any of the dimensions of the device 20.

Figure 7:
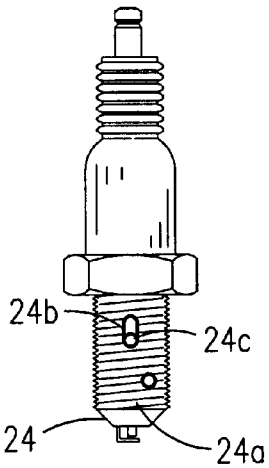
FIG. 7 is a front view of a modified spark plug as part of and used in conjunction with a decompression valve for a motorcycle engine such as the "Harley-Davidson®" "V-Twin®", according to the preferred embodiment of the present invention.

Referring now to FIG. 7, the modification to spark plug 24 involves drilling a 0.089 inch diameter hole, denoted as aperture 24*b* through the threaded base 24*a* so as to intersect the internal tapered surface of the dielectric material 24*d*. This opens an airway from the inside of the spark plug 24 around the dielectric material 24*d* to the outside of the plug. This location is determined by using a 0.010 inch diameter wire gauge. The gauge is inserted into the electrode hole to find the depth to the tapered dielectric surface 24*d* (not shown in this FIG.), and consequently the location to drill a hole for forming slot 24*c*.From this aperture 24*b*, and extending toward the non-threaded area of threaded base 24*a*, a 0.089 inch deep by 0.089 inch wide slot, denoted as slot 24*c*,is cut into threaded base 24. The length of slot 24*c* is variable and depends upon the particular spark plug 24 manufacturer and the internal length of dielectric insulator 24*d*. Slot 24*c* is used to direct, or channel, the gas vapor from aperture 24*b* in threaded base 24 into gas port chamber 23*d*. The gas vapor is then forced through vent tube 22 and against valve 21. (See FIG. 5) Compressed gas vapor, generated on the compression stroke, is forced through a minute aperture located on the side of valve 21. A visible burst of vapor is expelled through this aperture away from valve 21. When piston 7 reaches the ignition point in the cycle the additional expansion of gas closes valve 21.

2. Operation of the Preferred Embodiment

To use the present invention, one simply removes the spark plug from the cylinder and replaces it with a modified spark plug. The spark plug threaded base is inserted through an aperture in the center of the gas port chamber. The upper portion of the threaded base of the modified spark plug is thereby encapsulated by the gas port chamber. A specially formed hole and slot direct compressed gas and vapor into a specially formed chamber on the interior of the gas port chamber. The compressed gas and vapor is directed from this chamber to a vent tube having a valve on the other end which prevents the gas from escaping into the atmosphere. By depressing a plunger located on the top of the valve, a motorcycle operator can vent a small portion of compressed gas and vapor to the atmosphere. This is done when starting the engine to reduce the pressure in the combustion chamber prior to combustion. When combustion occurs, the resulting increase in pressure closes the valve until depressed again by the operator at startup.

The foregoing description is included to illustrate the operation of the preferred embodiment and is not meant to limit the scope of the invention. The scope of the invention is to be limited only by the following claims.

What is claimed is:

1. An internal combustion engine decompression valve kit for an internal combustion engine comprising: p1 a spark plug, said spark plug being of the hot type having an elongated threaded base and modified to have a slot cut into a sidewall of a said elongated threaded base to allow cylinder pressure to escape to the exterior of said sidewall, and wherein said spark plug is to be installed in a spark plug port of said engine in place of the regular spark plug;

a valve, said valve having a valve base and an interior chamber;

a valve plunger, said valve plunger located on the top of said valve and normally biased in the closed position for placing the interior chamber of said valve in fluid communication with the atmosphere;

a gas port chamber, said gas port chamber being ring shaped and having an aperture in a center for receiving therethrough said spark plug, wherein said gas port chamber encapsulates said elongated threaded base of said spark plug between the base of the spark plug and the cylinder head of said engine and receives cylinder pressure from said exterior of said elongated threaded base of said spark plug; and a vent tube, said vent tube connected to said gas port chamber, and wherein an opposite end of said vent tube is connected to said valve base of said valve, and further, said vent tube places said gas port chamber in fluid communication with said the interior chamber of said valve;

and wherein said vent tube consists of a short piece of formed or contoured steel tubing approximately two inches long, with an 0.180 inch outer diameter and an 0.089 inch inner diameter, and wherein all of said connections to said valve base and said gas port chamber are welded or brazed.

2. An internal combustion engine decompression valve kit for an internal combustion engine of claim 1, wherein an outer diameter of said gas port chamber and a diameter of said aperture necessarily will be different for different engine models and manufacturers as well as different spark plugs used therewith.

3. An internal combustion engine decompression valve kit for an internal combustion engine of claim 2, wherein for the "Harley-Davidson®" "V-Twin®" engine, the outer diameter of the gas port chamber is 0.8 inch, the diameter of said aperture is 0.550 inch, and wherein a second hole with a diameter of 0.585 inch and a depth of 0.200 inch is drilled to form a lip wherein and said gas port chamber wherein cylinder gas collects before being vented through said vent tube.

4. An internal combustion engine decompression valve kit for an internal combustion engine of claim 2, wherein for a "Harley-Davidson®" "Sportster®" model engine, the dimensions of the gas port chamber are 0.750 inch for the outer diameter, 0.469 inch for the diameter of said aperture, and 0.500 inch for the diameter of a second hole drilled to a depth of 0.200 inch in a lower portion of said gas port chamber to form said interior chamber and said lip.

5. An internal combustion engine decompression valve kit for an internal combustion engine of claim 4, wherein said spark plug is inserted through said aperture in said gas port chamber and said lip of said gas port chamber faces downward facing the surface of the cylinder wall of said engine where the spark plug port is located.

6. An internal combustion engine decompression valve kit for an internal combustion engine of claim 5, wherein said spark plug includes a 0.089 inch diameter hole through said threaded base so as to intersect an internal tapered surface of the dielectric material of said spark plug to open an airway from the inside of the spark plug around the dielectric material to the outside of the plug.

7. An internal combustion engine decompression valve kit for an internal combustion engine of claim 6, wherein the location of said 0.089 inch diameter hole is determined by using a 0.010 inch diameter wire gauge, the gauge being inserted into the electrode hole to find the depth to the tapered dielectric surface, and consequently the location to drill a hole for forming said slot.

8. An internal combustion engine decompression valve kit for an internal combustion engine of claim 7, wherein a slot extends from said 0.089 diameter hole to a non-threaded area of said threaded base, said slot being 0.089 inch deep by 0.089 inch wide and wherein the length of said slot is variable and depends upon the particular spark plug manufacturer and the internal length of the dielectric insulator on the spark plug.

9. An internal combustion engine decompression valve kit for an internal combustion engine of claim 8, wherein compressed gas vapor generated on the compression stroke of the piston of said engine is forced through a minute aperture located on the side of said valve resulting in a visible burst of vapor expelled through said aperture away from said valve, and further wherein, when the piston reaches the ignition point in the cycle the additional expansion of gas closes said valve.

* * * * *